US009039002B2

(12) United States Patent
Fukatsu et al.

(10) Patent No.: US 9,039,002 B2
(45) Date of Patent: May 26, 2015

(54) SHEET POST-PROCESSING APPARATUS WITH FUNCTION OF PUNCHING SHEET

(71) Applicant: CANON KABUSHIKI KAISHA, Tokyo (JP)

(72) Inventors: Yasuo Fukatsu, Abiko (JP); Hitoshi Kato, Toride (JP); Naoki Ishikawa, Kashiwa (JP); Taishi Tomii, Matsudo (JP)

(73) Assignee: CANON KABUSHIKI KAISHA (JP)

( * ) Notice: Subject to any disclaimer, the term of this patent is extended or adjusted under 35 U.S.C. 154(b) by 0 days.

(21) Appl. No.: 13/967,458

(22) Filed: Aug. 15, 2013

(65) Prior Publication Data

US 2014/0053699 A1 Feb. 27, 2014

(30) Foreign Application Priority Data

Aug. 24, 2012 (JP) ..... 2012-185377

(51) Int. Cl.

| | |
|---|---|
| ***B26D 5/20*** | (2006.01) |
| ***B65H 35/04*** | (2006.01) |
| ***B26D 5/00*** | (2006.01) |
| ***B26D 5/32*** | (2006.01) |
| ***B26D 5/34*** | (2006.01) |
| ***B26F 1/00*** | (2006.01) |

(52) U.S. Cl.

CPC *B65H 35/04* (2013.01); *B26D 5/00* (2013.01); *B26D 5/32* (2013.01); *B26D 5/34* (2013.01); *B26F 1/0092* (2013.01)

(58) Field of Classification Search

USPC ..... 270/58.04, 58.07; 83/72–76, 360–372, 83/76.1, 76.7, 76.8

See application file for complete search history.

(56) References Cited

U.S. PATENT DOCUMENTS

| | | | | |
|---|---|---|---|---|
| 6,860,478 | B2 * | 3/2005 | Hirai | 270/58.07 |
| 7,007,577 | B2 * | 3/2006 | Okamoto et al. | 83/76.8 |
| 8,011,649 | B2 * | 9/2011 | Yahata et al. | 270/58.07 |
| 8,042,796 | B2 * | 10/2011 | Iguchi | 270/58.07 |
| 8,172,213 | B2 * | 5/2012 | Iguchi et al. | 270/58.07 |
| 2012/0227557 | A1 * | 9/2012 | Iguchi et al. | 83/73 |

FOREIGN PATENT DOCUMENTS

JP 2000-334694 A 12/2000

* cited by examiner

*Primary Examiner* — Leslie A Nicholson, III

(74) *Attorney, Agent, or Firm* — Rossi, Kimms & McDowell LLP

(57) ABSTRACT

A sheet post-processing apparatus which is capable of shortening time wasted until actual start of punching and enhancing productivity. A drive unit causes a moving member which has a cam and reciprocates. A punching member is driven by a movement of the cam of the moving member and punches a sheet when the moving member moves forth and moves back. A determination unit determines a type of the sheet. A control unit controls, when a sheet to be punched is to be subjected to a punching process, the drive unit such that the moving member starts moving before conveyance of the sheet to be punched stops, and controls, when the sheet to be punched is to be subjected to the punching process, the drive unit such that timing with which the moving member starts moving is changed based on the determination by the determination unit.

8 Claims, 17 Drawing Sheets

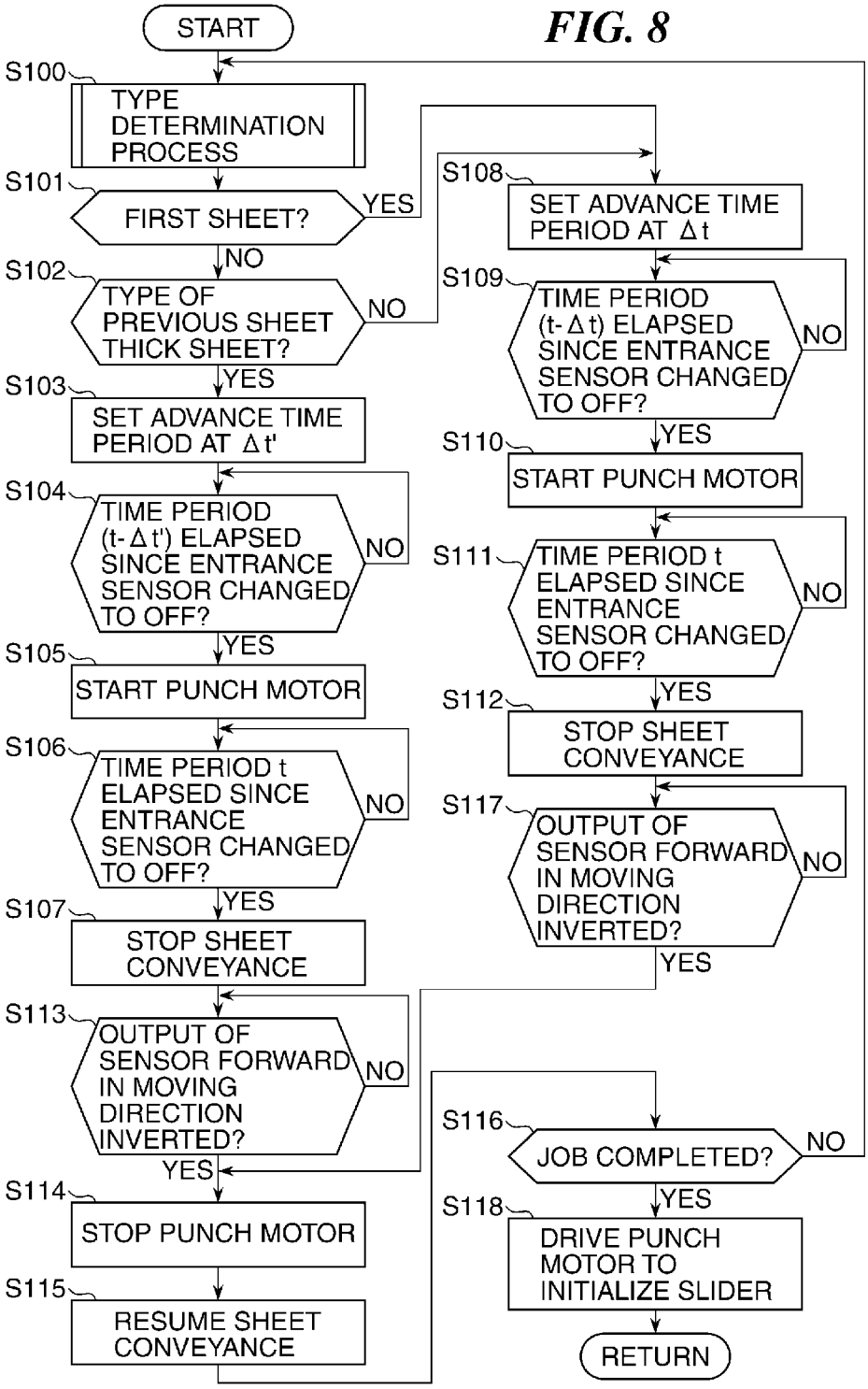
FIG. 8
START
S100
TYPE DETERMINATION PROCESS
S101
FIRST SHEET?
YES
NO
S102
TYPE OF PREVIOUS SHEET THICK SHEET?
NO
YES
S103
SET ADVANCE TIME PERIOD AT Δt'
S104
TIME PERIOD (t-Δt') ELAPSED SINCE ENTRANCE SENSOR CHANGED TO OFF?
NO
YES
S105
START PUNCH MOTOR
S106
TIME PERIOD t ELAPSED SINCE ENTRANCE SENSOR CHANGED TO OFF?
NO
YES
S107
STOP SHEET CONVEYANCE
S113
OUTPUT OF SENSOR FORWARD IN MOVING DIRECTION INVERTED?
NO
YES
S114
STOP PUNCH MOTOR
S115
RESUME SHEET CONVEYANCE
S108
SET ADVANCE TIME PERIOD AT Δt
S109
TIME PERIOD (t-Δt) ELAPSED SINCE ENTRANCE SENSOR CHANGED TO OFF?
NO
YES
S110
START PUNCH MOTOR
S111
TIME PERIOD t ELAPSED SINCE ENTRANCE SENSOR CHANGED TO OFF?
NO
YES
S112
STOP SHEET CONVEYANCE
S117
OUTPUT OF SENSOR FORWARD IN MOVING DIRECTION INVERTED?
NO
YES
S116
JOB COMPLETED?
NO
YES
S118
DRIVE PUNCH MOTOR TO INITIALIZE SLIDER
RETURN

| SHEET THICKNESS (mm) | SHEET TYPE |
|---|---|
| 0.093 | A SHEET |
| 0.107 | B SHEET |
| . . . | . . . |
| . . . | . . . |

*FIG. 13A* *PRIOR ART*
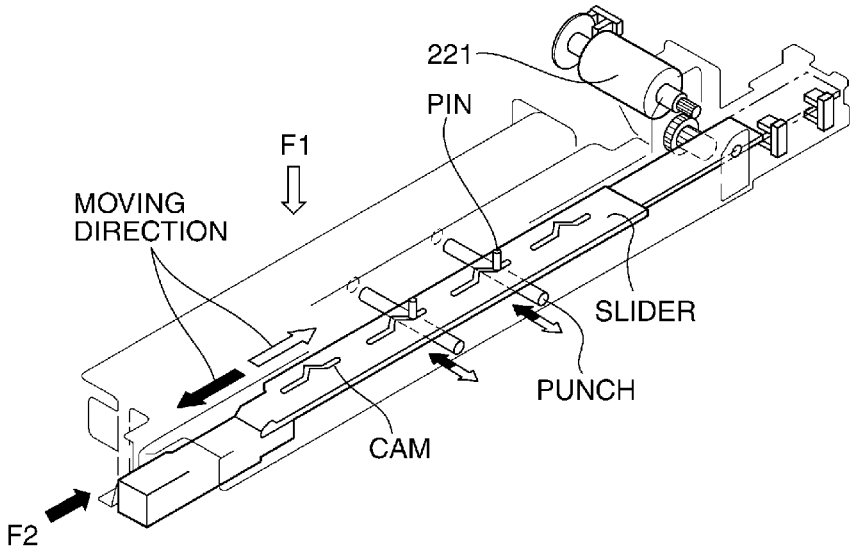
*FIG. 13B* *PRIOR ART*
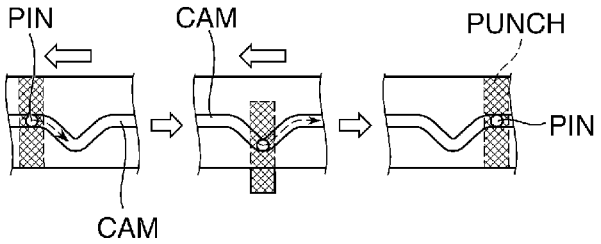
*FIG. 13C* *PRIOR ART*
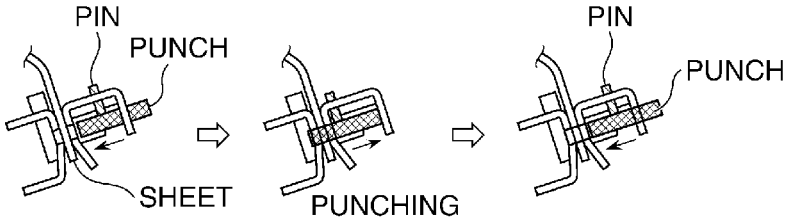

*FIG. 14A* *PRIOR ART*
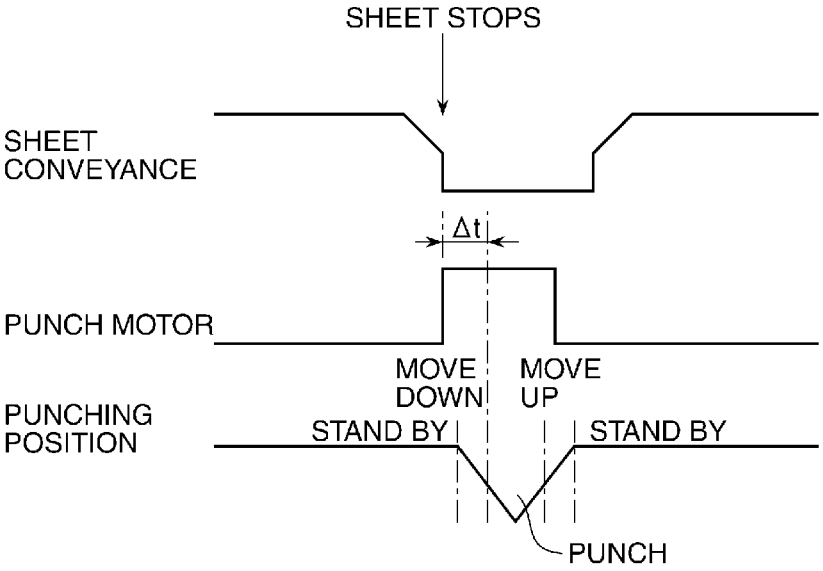
*FIG. 14B* *PRIOR ART*
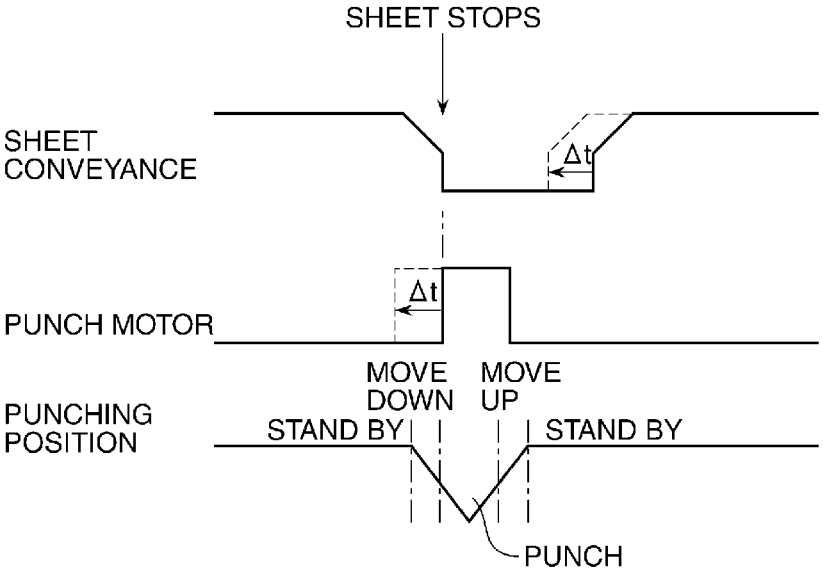

*FIG. 15A* *PRIOR ART*
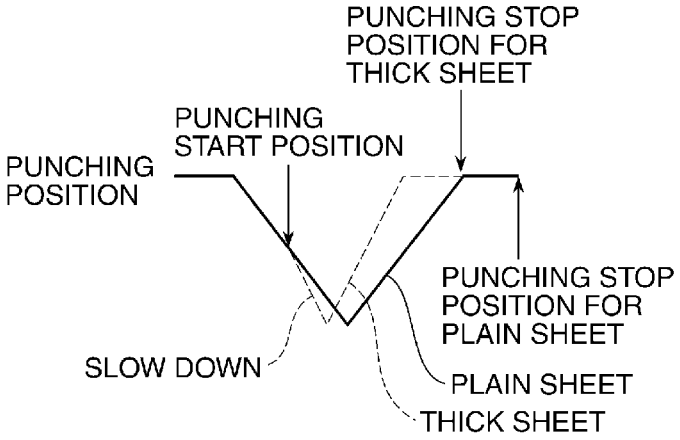
*FIG. 15B* *PRIOR ART*
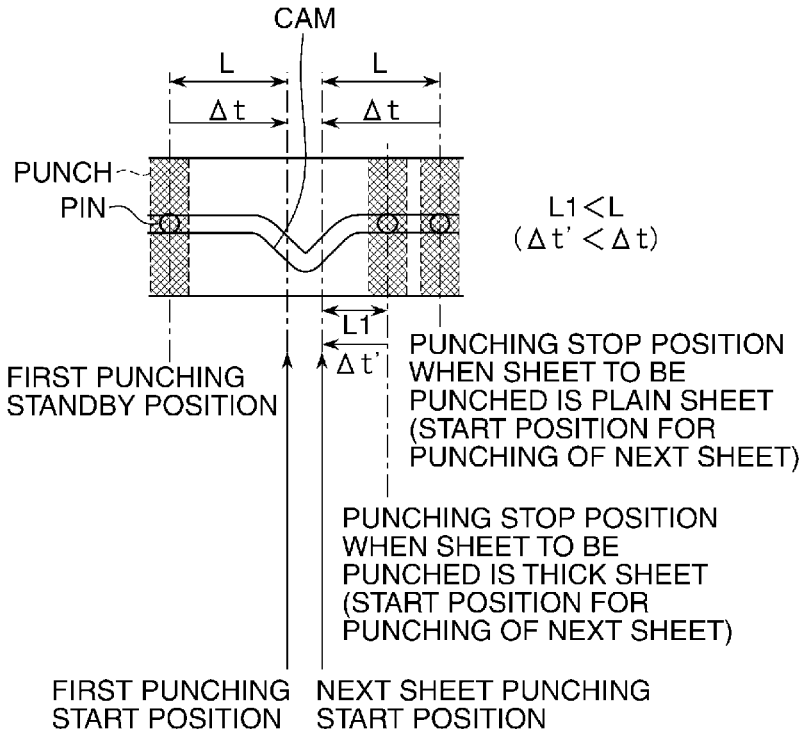

*FIG. 16* *PRIOR ART*
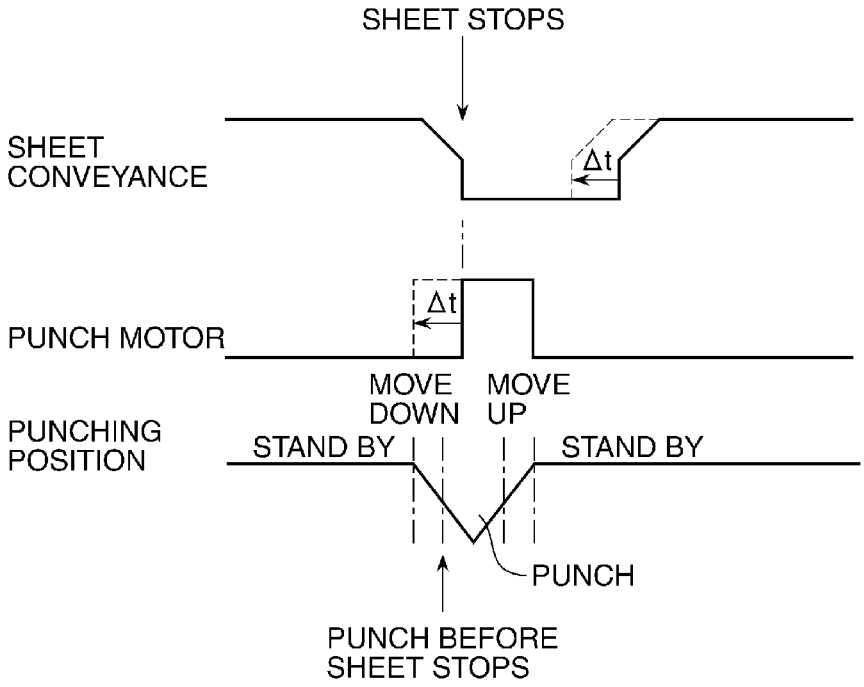

SHEET POST-PROCESSING APPARATUS WITH FUNCTION OF PUNCHING SHEET

BACKGROUND OF THE INVENTION

1. Field of the Invention

The present invention relates to a sheet post-processing apparatus having a function of punching a sheet.

2. Description of the Related Art

Conventionally, some sheet post-processing apparatuses connected to an image forming apparatus are equipped with a sheet punching apparatus that punches a recording sheet. Sheet punching apparatuses include those of a press-punch type that temporarily stops sheets with images formed thereon when they are being conveyed and punches the sheets one by one, and those of a rotary type that punches sheets without stopping them. In general, hole positions are more accurate with the press-punch type than with the rotary type. The press-punch type, however, stops sheets one by one whenever it punches them, and hence it takes much time to punch the sheets.

To address this problem, according to Japanese Laid-Open Patent Publication (Kokai) No. 2000-334694, while sheets are being conveyed so as to be guided into a sheet punching apparatus, starting of a punch motor for punching is advanced so as to shorten the time from stop of sheet conveyance to start of punching so that high speed punching can be realized.

A description will now be given of a conventional sheet punching apparatus with reference to FIGS. 13 to 16.

FIG. 13A is a perspective view showing the conventional sheet punching apparatus, FIGS. 13B and 13C are views taken from directions F1 and F2, respectively, in FIG. 13A.

Referring to FIG. 13A, the conventional sheet punching apparatus causes a slider, which has cam grooves, to reciprocate by a punch motor 221 which is a drive unit, thus punching a sheet using punches integrated with pins moving inside the cam grooves. The pins engaging with the cam grooves cause the punches to reciprocate in a direction perpendicular to a direction in which the slider reciprocates.

FIGS. 14A and 14B are timing charts showing sheet conveyance, punch motor, and punch position in a punching process.

Referring to FIG. 14A, a time period Δt elapses from when a sheet stops and the punch motor 221 is started to when the punches actually punch the sheet. This time period Δt is set as an advance time period, and as shown in FIG. 14B, starting of the punch motor 221 and resumption of sheet conveyance are advanced by the time period Δt, so that the time period required for punching can be shortened.

In a case where, however, a sheet to be punched is a thick sheet, the load put on the punches when they punches the sheet is heavier compared to a plain sheet. For this reason, the punch motor 221 driving the slider lows down to a large degree.

FIG. 15A is a conceptual diagram showing positions of the punch over time with comparison between a thick sheet and a plain sheet. FIG. 15B is a diagram showing changes in positions of the punch and the cam groove in the slider.

Movement of the slider causes the pin to move along the cam groove in the slider. Stopping the punch motor 221 causes the slider to stop, but the punch motor 221 does not immediately stop moving and moves a small amount after being braked. As a result, the slider overruns.

As described above, the slider slows down when punching a thick sheet, and hence even when an attempt to stop the slider with the same timing as in the case of a plain sheet, the slider stops earlier compared to the plain sheet. For example, assume that when a plain sheet is to be punched immediately after a thick sheet is punched, punching is started with a predetermined advance time irrespective of a sheet type, in particular, a sheet thickness as in the prior art. Then, as shown in FIG. 15B, a position at which the punch stops in the case of the thick sheet is relatively close to a punching position compared to a position at which the punch stops in the case of the plain sheet.

Punching of a next sheet is carried out by reversing a direction in which the slider moves, and as shown in FIG. 15B, a position (L1) close to a punching position is a relative initial position of the slider and the punch. Assume that under the circumstances, the punch motor 221 is started so as to punch a next sheet with an advance time period set at Δt as shown in a timing chart of FIG. 16. The time it takes for the punch to actually punch the sheet is Δt' (Δt'<Δt) (FIG. 15B), and hence punching is started earlier than proper timing.

To circumvent the situation where punching occurs at a position in front of a target punching position, it is necessary to set a short advance time period so that punching can be started after a sheet is reliably stopped. For example, when the immediately preceding sheet to be punched is a thick sheet and a sheet to be punched this time is a pain sheet, it is necessary to set a short advance time period so as to retard activation of the punch motor 221.

Thus, when the advance time period is set at a predetermined value, the predetermined time period needs to be a uniform value at which activation of the punch motor 221 can be the latest with consideration given to a thickness of each sheet.

The longer the advance time period, the earlier the start of the punch motor 221 and the higher the productivity. According to the prior art, however, even in a case where only plain sheets are punched as a result, punching is carried out with a uniform advance time period set as long as there is a possibility that a thick sheet is punched. For this reason, there is a problem of productivity being not enhanced to a sufficient degree.

Thus, remedial measures are desired so as to deal with the situation where the effect of shortening punching time by setting an advance time period cannot be obtained to a satisfactory level due to the slider overrunning after the punch motor 221 stops.

SUMMARY OF THE INVENTION

The present invention provides a sheet post-processing apparatus capable of shortening time wasted until actual start of punching and enhancing productivity.

Accordingly, a first aspect of the present invention provides a sheet post-processing apparatus comprising a moving member configured to have a cam and reciprocate, a drive unit configured to cause the moving member to reciprocate, a punching member configured to be driven by a movement of the cam of the moving member and punch a sheet when the moving member moves forth and moves back, a determination unit configured to determine a type of the sheet, and a control unit configured to, when a sheet to be punched is to be subjected to a punching process, control the drive unit such that the moving member starts moving before conveyance of the sheet to be punched stops, and when the sheet to be punched is to be subjected to the punching process, control the drive unit such that timing with which the moving member starts moving is changed based on the determination by the determination unit.

Accordingly, a second aspect of the present invention provides a sheet post-processing apparatus comprising a moving member configured to have a cam and reciprocate, a drive unit configured to cause the moving member to reciprocate, a punching member configured to be reciprocated, when the moving member moves forth and moves back, by a movement of the cam of the moving member, and punch a sheet, a measurement unit configured to measure a travel amount of the moving member, a detection unit configured to detect, with respect to a position of the moving member at timing with which the punching member changes a direction of movement in reciprocating movement, a first state in which the moving member is distant by a predetermined distance in a first direction between the directions of movement of the moving member and a second state in which the moving member is distant by the predetermined distance in a second direction opposite to the first direction, and a control unit configured to, in a case where a sheet to be punched is subjected to a punching process, (i) control the drive unit such that the moving member starts moving before conveyance of the sheet to be punched is stopped, (ii) control the drive unit such that the drive unit stops driving when a first travel amount of the moving unit measured by the measurement unit from when the drive unit starts driving until the detection unit detects the first state and a second travel amount of the moving unit measured by the measurement unit after the detection unit detected the second state become equal, and (iii) control the drive unit so as to cause the moving member to move to a predetermined position by a third travel amount of the moving member, which is measured by the measurement unit from when the drive unit stops driving until the moving member stops, by changing the direction of movement of the moving member.

According to the present invention, time wasted until actual start of punching can be shortened to enhance productivity.

Further features of the present invention will become apparent from the following description of exemplary embodiments (with reference to the attached drawings).

BRIEF DESCRIPTION OF THE DRAWINGS

FIG. 8 is a flowchart showing a punching process.

FIG. 13A is a perspective view showing a conventional sheet post-processing apparatus, and FIGS. 13B and 13C are views taken from directions F1 and F2, respectively, in FIG. 13A.

FIGS. 14A and 14B are timing charts of sheet conveyance, punch motor, and punch position in the punching process.

FIG. 15A is a conceptual diagram showing positions of punches over time with comparison between a thick sheet and a plain sheet, and FIG. 15B is a diagram showing relative changes in positions of the punches and cam grooves of a slider.

FIG. 16 is a timing chart of the punching process.

DESCRIPTION OF THE EMBODIMENTS

The present invention will now be described in detail with reference to the drawings showing embodiments thereof.

Figure 1:
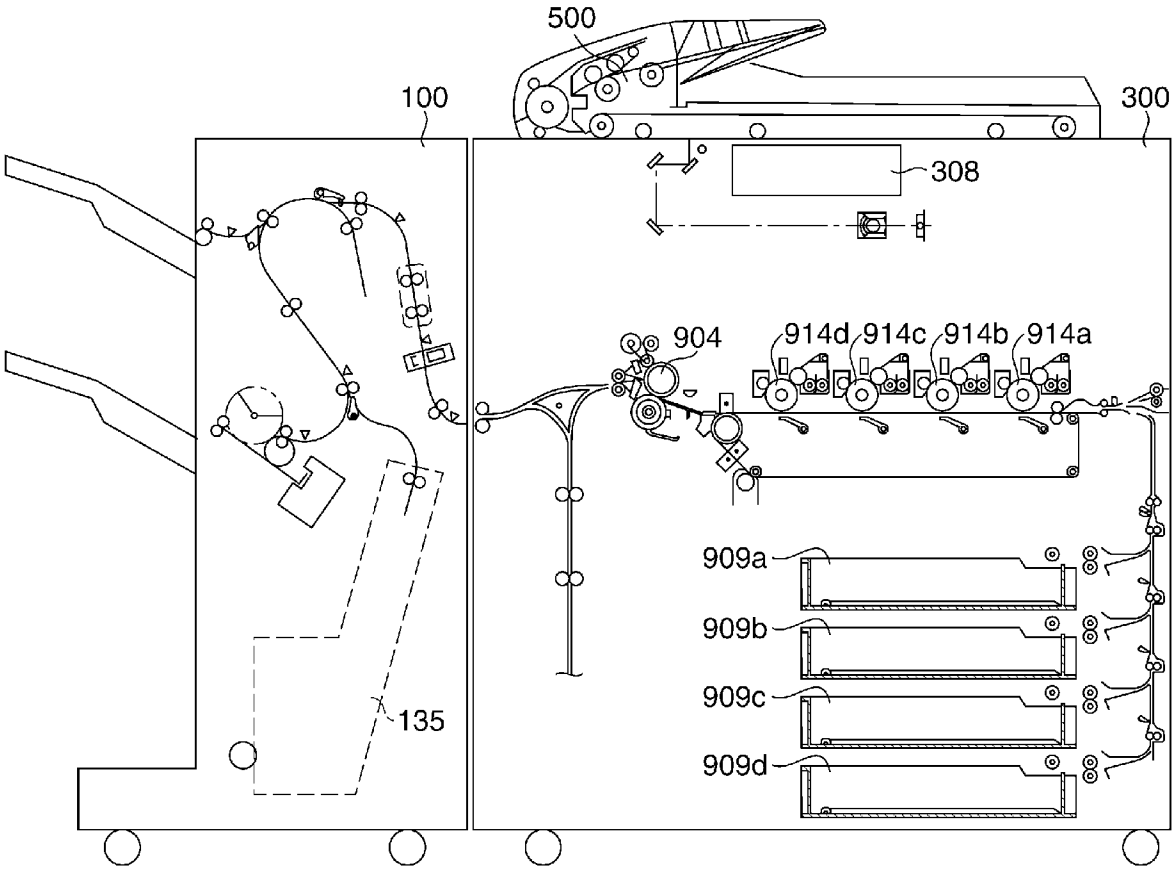
FIG. 1 is a view schematically showing an overall arrangement of an image forming system having a sheet post-processing apparatus according to a first embodiment of the present invention.

FIG. 1 is a view schematically showing an overall arrangement of an image forming system having a sheet post-processing apparatus according to a first embodiment of the present invention.

This image forming system has an image forming apparatus 300, an automatic original feeding apparatus 500, and the sheet post-processing apparatus 100. The sheet post-processing apparatus 100 is connected to the image forming apparatus 300 and has a saddle stitching unit 135 and a side stitching unit which is a sheet stacking unit. In the present embodiment, the sheet post-processing apparatus 100 and the image forming apparatus 300 are configured as separate units, but may be configured as an integral unit.

Toner images of the four colors are transferred onto a sheet, which is a recording material fed from any of cassettes 909*a* to 909*d* in the image forming apparatus 300, by respective yellow, magenta, cyan, and back photosensitive drums 914*a* to 914*d*. The sheet is then conveyed to a fixing unit 904, which in turn fixes the toner images on the sheet, and the sheet is conveyed to the sheet post-processing apparatus 100. The image forming apparatus 300 is equipped with an operation unit 308.

Figure 2:
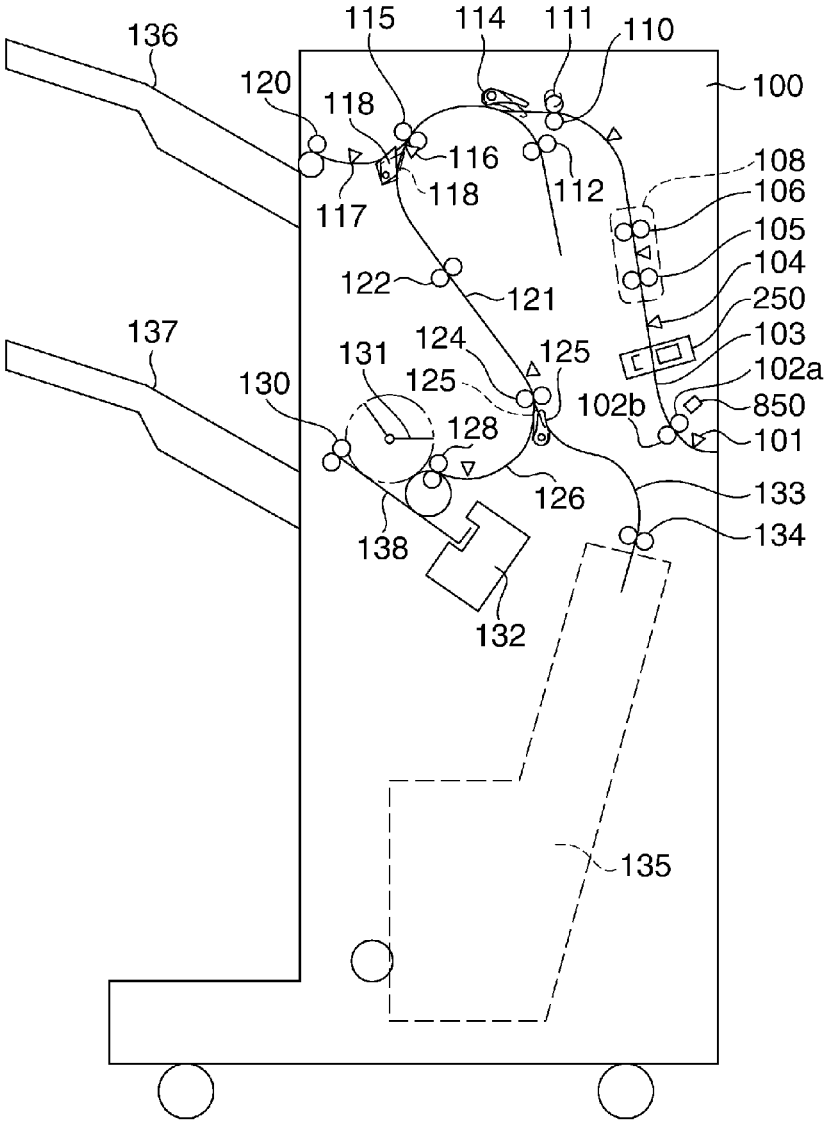
FIG. 2 is a view schematically showing an arrangement of the sheet post-processing apparatus.

FIG. 2 is a view schematically showing an arrangement of the sheet post-processing apparatus 100.

A sheet discharged from the image forming apparatus 300 is delivered to an entrance roller pair 102 (rollers 102*a* and 102*b*) of the sheet post-processing apparatus 100. At this time, an entrance sensor 101 detects the delivery timing of the sheet as well.

A non-contact laser displacement meter 850 measures the displacement of the roller 102*a* of the entrance roller pair 102. A detailed description will be given later of the laser displacement meter 850.

While the sheet conveyed by the entrance roller pair 102 passes through a conveying path 103, an end position of the sheet in a width direction (a direction vertical to a sheet surface) perpendicular to a sheet conveying direction is detected by a side end sensor 104. The amount of lateral skew of the sheet is obtained based on the detected end position. The sheet is then moved toward the front or rear by a shift unit 108 to correct for a lateral skew (shifting operation). This shifting operation is performed while the sheet is being conveyed by shift roller pairs 105 and 106.

In the conveying path 103, a punch unit 250 is disposed between the entrance roller pair 102 and the shift unit 108. After the lateral skew of the sheet is corrected for by the shift unit 108, holes are punched in the sheet by the punch unit 250. It should be noted that when punching has not been ordered, punching is not performed.

The sheet is then conveyed by a conveying roller 110, a separation roller 111, and a buffer roller pair 115, and then conveyed to an upper conveying path 117 or a bundle conveying path 121. When the sheet is to be guided to the upper conveying path 117, an upper path switching flapper 118 comes into a state indicated by a broken line in the figure, and the sheet is discharged onto an upper tray 136 by an upper sheet discharging roller 120.

On the other hand, when the sheet is to be guided to the bundle conveying path 121, the upper path switching flapper 118 goes into a state indicated by a solid line in the figure, and the sheet is caused to pass through the bundle conveying path 121 by a buffer roller pair 122 and a bundle conveying roller pair 124 in succession.

When saddle stitching to the sheet is requested, a saddle path switching flapper 125 goes into a state indicated by a broken line by a solenoid (not shown), so that the sheet is conveyed to a saddle path 133. Further, the sheet is guided to the saddle switching unit 135 and subjected to saddle stitching. Saddle stitching, which is a common process, is not an essential of the present invention, and hence detailed description thereof is omitted.

On the other hand, when the sheet is to be discharged onto an upper tray 137, the saddle path switching flapper 125 goes into a state indicated by a solid line by a solenoid (not shown), so that the sheet is conveyed to a lower path 126 by the bundle conveying roller pair 124 and the saddle switching flapper 125. The sheet is then discharged onto an intermediate processing tray 138 by a lower sheet discharging roller pair 128. Sheets are aligned into a sheet bundle on the intermediate processing tray 138 by a paddle 131 and a moving-back unit such as a knurling belt (not shown). After that, the sheet bundle is subjected to saddle stitching by a stapler 132 as the need arises, and the sheet bundle is then discharged onto the lower tray 137 by a bundle sheet discharging roller pair 130.

Figure 3A:
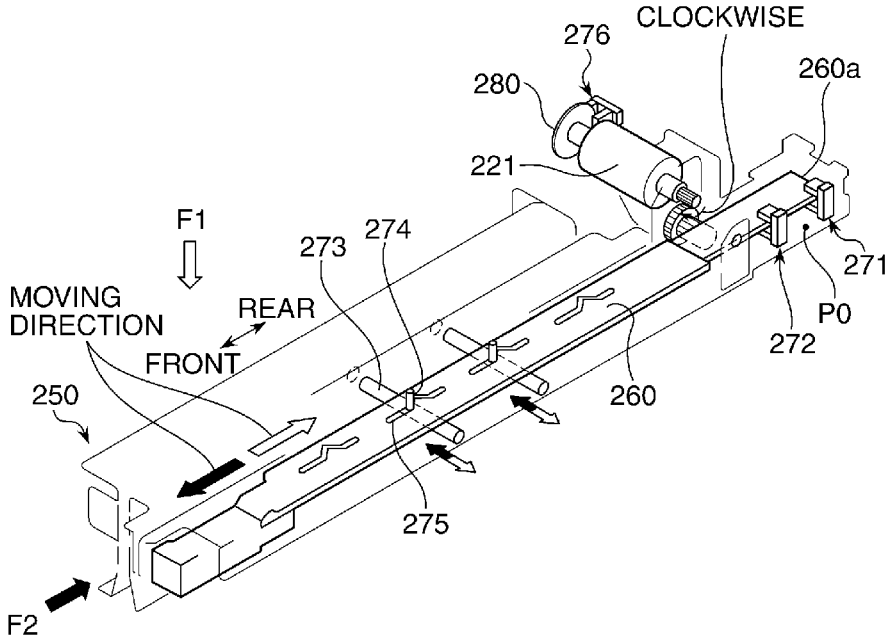
FIG. 3A is a perspective view showing an internal arrangement of a punch unit.
Figure 3B:
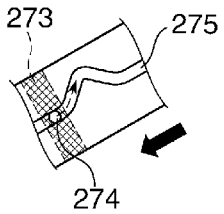
FIGS. 3B and 3C are views taken from directions F1 and F2, respectively, in FIG. 3A.
Figure 3C:
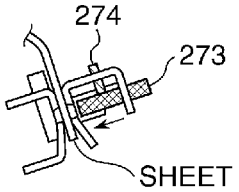
Figure 4A:
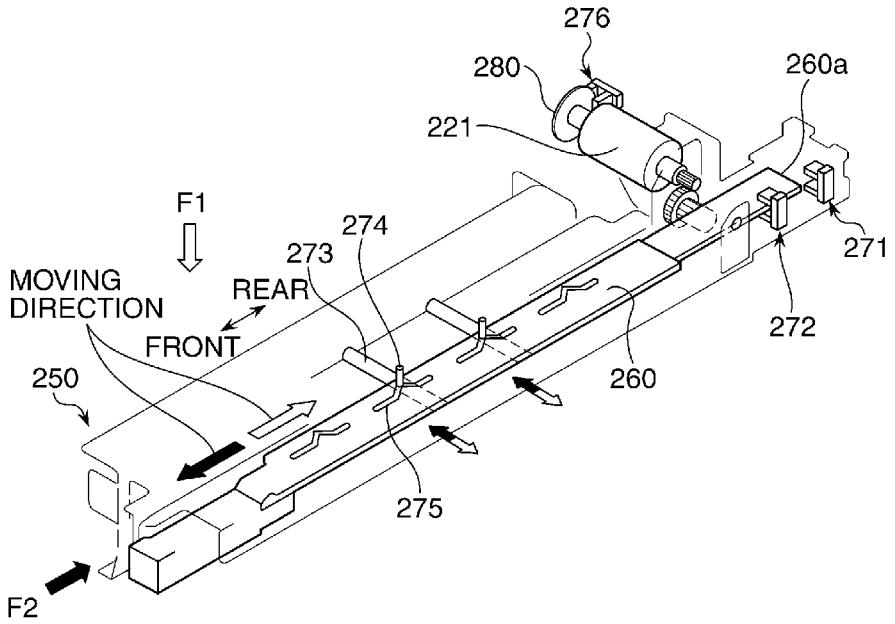
FIG. 4A is a perspective view showing the internal arrangement of the punch unit.
Figure 4B:
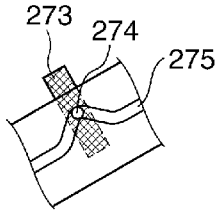
FIGS. 4B and 4C are views taken from the directions F1 and F2, respectively, in FIG. 4A.
Figure 4C:
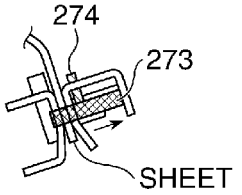
Figure 5A:
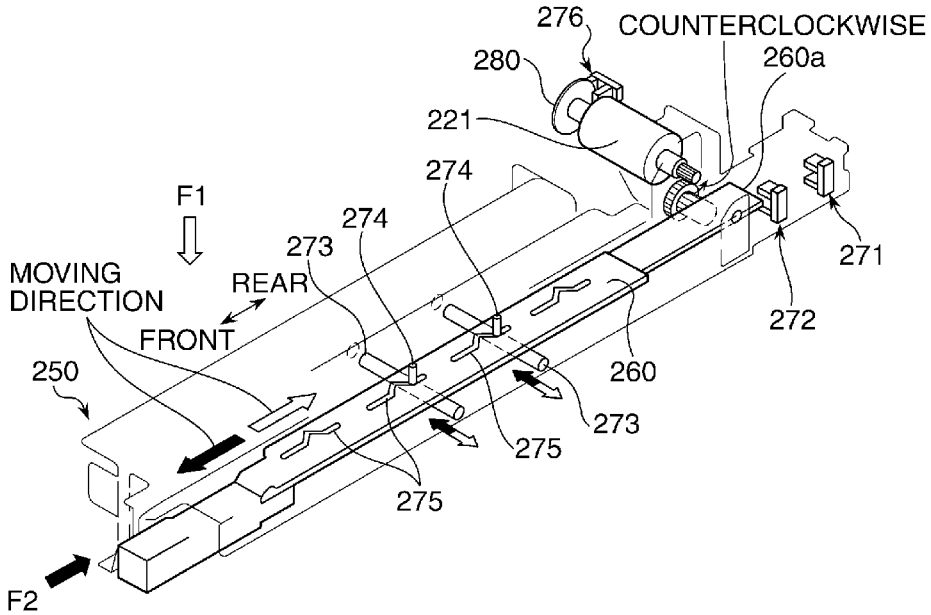
FIG. 5A is a perspective view showing the internal arrangement of the punch unit.
Figure 5B:
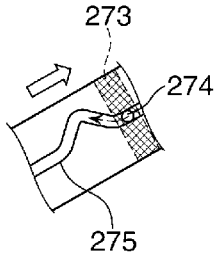
FIGS. 5B and 5C are views taken from the directions F1 and F2, respectively, in FIG. 5A.
Figure 5C:
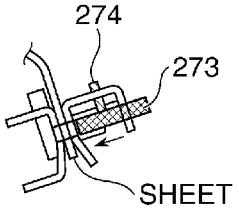

FIGS. 3A to 5C schematically show an internal arrangement of the punch unit 250 which is a punch device that performs punching. FIGS. 3A, 4A, and 5A are perspective views showing an overall arrangement of the punch unit 250. FIGS. 3B, 4B, and 5B show the positional relationship between a pin and a cam groove in the punch unit 250 as viewed from a direction indicated by an arrow F1 in the state shown in FIGS. 3A, 4A, and 5A, respectively. FIGS. 3C, 4C, and 5C show the positional relationship between a sheet and a punch as viewed from a direction indicated by an arrow F2 in the state shown in FIGS. 3A, 4A, and 5A, respectively. It should be noted that a direction opposite to the direction indicated by the arrow F1 is a sheet conveying direction.

The punch unit 250 is comprised mainly of a slider 260 which is a moving member, punches 273 which are punching members, and a punch motor 221 which is a drive unit. The punch unit 250 also has a punch home position 1 sensor 271 (hereafter referred to as the first HP sensor 271) and a punch home position 2 sensor 272 (hereafter referred to as the second HP sensor 272).

The slider 260 is driven by the punch motor 221 to reciprocate toward the front and the rear. The front corresponds to a front side of a sheet as viewed in FIG. 2. A plurality of cam grooves 275 are formed in the slider 260. Each of the cam grooves 275 has a dogleg part as viewed from the direction F1, and portions joined to the dogleg portion and parallel to the slider 260. Each of the cam grooves 275 is symmetric with respect to a peak of the dogleg portion in the moving directions of the slider 260.

On the other hand, pins 274 are fixed in a projecting manner to the punches 273. The pins 274 are inserted into and engaged with the cam grooves 275. The punches 273 are inhibited from moving in the moving directions of the slider 260, and disposed so as to reciprocate in a punching direction (vertical to the directions F1 and F2) vertical to the moving directions of the slider 260. The punches 273 punch a conveyed sheet once when the slider 260 moves back and once when the slider 260 moves forth.

Although only the two punches 273 are shown in FIGS. 3A to 5C, punches corresponding in number to the number of punched holes may be provided together with the cam grooves 275 when the punches 273 are applied to a multi-hole puncher. All the punches 273 work in the same way.

Assume that positions of the slider 260 and the punches 273 shown in FIG. 3 are initial positions of the slider 260 and the punches 273. When the slider 260 is at the initial position, and the punch motor 221 rotates clockwise, the slider 260 moves toward the front side from the initial position which is a movement starting position. This causes the pins 274 to move within the cam grooves 275. In the end, as shown in FIG. 4A, the pins 274 move to the dogleg portions of the cam grooves 275, and as a result, the punches 273 moving in response to the movement of the pins 274 move vertically with respect to a surface of a sheet to be punched and punch the sheet.

When the slider 260 further moves toward the front side, the pins 274 move from the dogleg portions to the straight portions, and as a result, the punches 273 move in a direction opposite to the punching direction and completes punching. The slider 260 then moves to a position shown in FIG. 5A.

Here, in the process of punching, the time at which the punches 273 come into a contact state with a sheet from a non-contact state when the slider 260 moves forth is defined as "the start of actual punching", and the time at which the punches 273 come out of holes being punched when the slider 260 moves back (the time at which the punches 273 come into the non-contact state from the contact state) is defined as "actual end of punching".

When the slider 206 is at the position shown in FIG. 5 and the punch motor 221 rotates counterclockwise, the slider 260 moves toward the rear. The direction in which the slider 260 moves is opposite to the direction in which the slider 260 moves from the initial position, but movements of the pins 274 and the punches 273 are the same as those in the case where the slider 260 moves toward the front.

The first HP sensor 271 and the second HP sensor 272, both of which are transmission type photointerrupters, detect a position of the slider 260 in the moving directions thereof. For example, when both the first HP sensor 271 and the second HP sensor 272 are shielded from light by the slider 260 as shown in FIG. 3, this means that the slider 260 lies in the rear. Also, when neither the first HP sensor 271 nor the second HP sensor 272 is shielded from light by the slider 260 as shown in FIG. 5, this means that the slider 260 lies in the front.

Here, as shown in FIG. 3, the end position 260*a* of the slider 260 in the rear in the moving directions of the slider 260 is referred to as "the specific portion". By detecting this end position 260*a* which is the specific portion, a position of the slider 260 in the moving directions of the slider 260 is ascertained.

The first HP sensor 271 and the second HP sensor 272 are disposed at a first position and a second position, respectively, in the moving directions of the slider 260. An intermediate position between the first HP sensor 271 and the second HP sensor 272 is designated by P0. In the respective of directions in which the slider 260 moves forth and moves back, the first HP sensor 271 and the second HP sensor 272 are at the same distance from the intermediate position P0.

When the end position 260*a* of the slider 260 is at the intermediate position P0, the pins 274 lie at centers of the cam grooves 275 (the peaks of the dogleg portions of the cam grooves 275) and accordingly, the moving direction of the punches 273 is inverted. Thus, when the punches 273 are halfway between actual start of punching and actual end of punching in the process of punching, the end position 260*a* is at the intermediate position P0.

The first and second HP sensors 271 and 272 act as a detection unit that detects the end position 260*a* of the slider 260 having passed the first position and the second position, respectively. In the present embodiment, results of detection by the first and second HP sensors 271 and 272 are used in determining the timing with which the punch motor 221 is stopped. It should be noted that in a second embodiment of the present invention, results of detection by the first and second HP sensors 271 and 272 are also used as information associated with measurement of the travel amount of the slider 260 (this will be described later in detail).

For example, assume that the slider 260 moves from the initial position to the first position and the second position in this order (toward the front) and performs punching. In this case, the punch motor 221 is stopped when the end position 260*a* leaves the second HP sensor 272 and the second HP sensor 272 becomes unshielded from light. Conversely, in a case where the slider 260 moves from the initial position to the second position and the first position in this order (toward the rear) and performs punching, the punch motor 221 is stopped when the end position 260*a* lies over the first HP sensor 271 to shield the first HP sensor 271 from light.

An encoder 280 is provided on an opposite side of an output shaft of the punch motor 221. When the punch motor 221 rotates, the encoder 280 generates clocks from a punch motor clock sensor 276 which is a transmission-type photo-interrupter. By counting the clocks, the travel amount of the slider 260 driven by the punch motor 221 can be detected and measured.

Figure 6A:
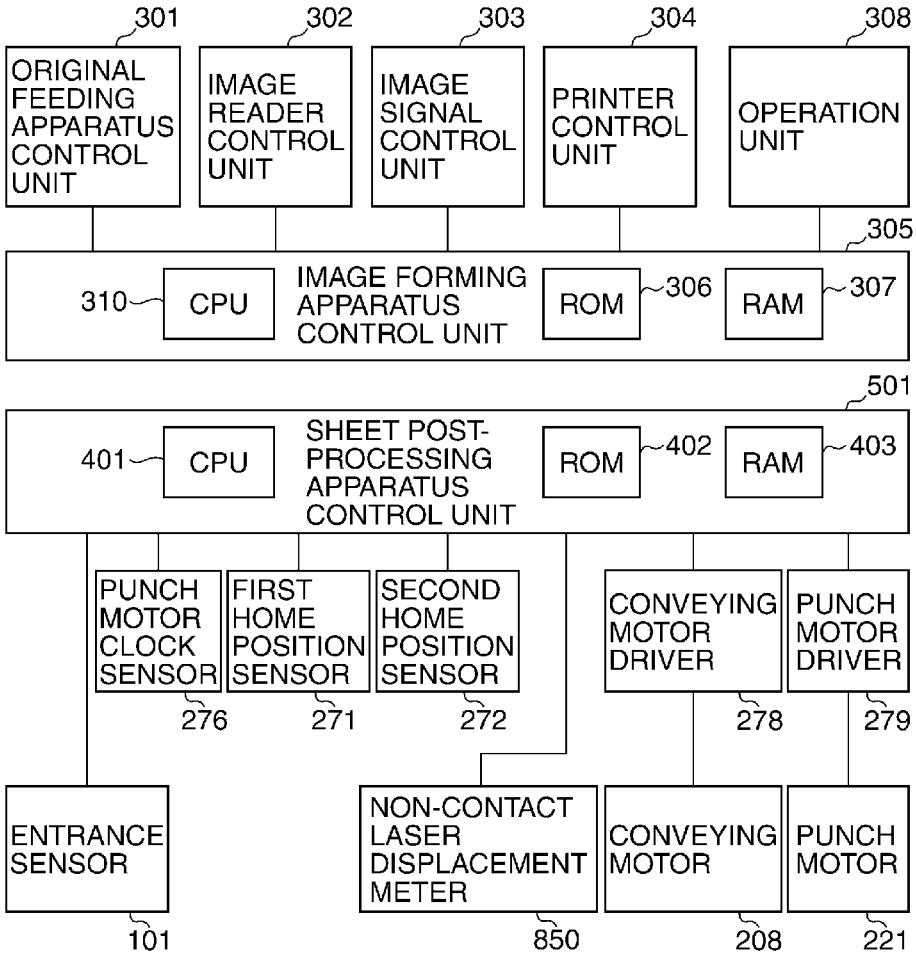
FIG. 6A is a control block diagram showing an image forming apparatus and the sheet post-processing apparatus.
Figure 6B:
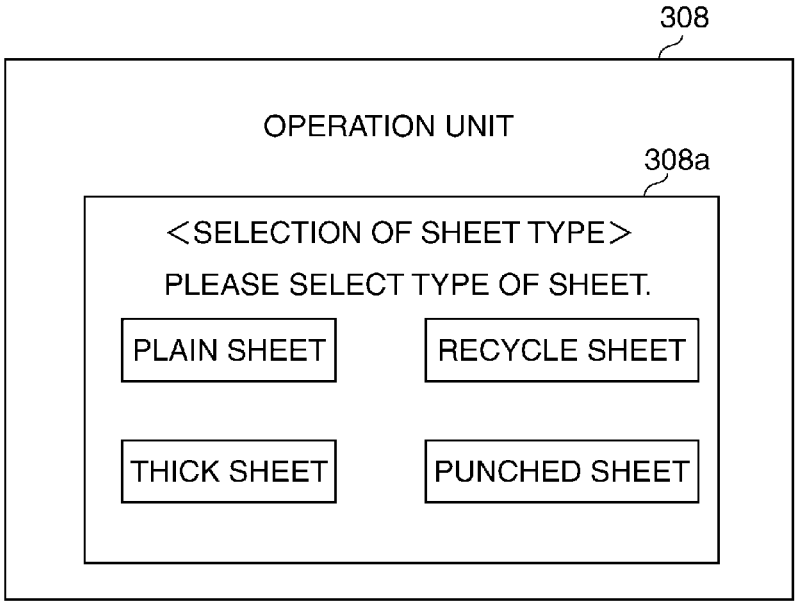
FIG. 6B is a diagram showing an exemplary screen layout on an operation screen of an operation unit.

FIG. 6A is a control block diagram showing the image forming apparatus 300 and the sheet post-processing apparatus 100. FIG. 6B is a diagram showing an exemplary screen layout on an operation screen of the operation unit 308.

Referring to FIG. 6A, an image forming apparatus control unit 305 has a CPU 310, a ROM 306, and a RAM 307 incorporated therein. An original feeding apparatus control unit 301, an image reader control unit 302, an image signal control unit 303, a printer control unit 304, the operation unit 308, and a sheet post-processing apparatus control unit 501 are subjected to centralized control in accordance with control programs stored in the ROM 306. The RAM 307 is used to temporarily hold control data and act as a work area for computations associated with control to retain data.

The original feeding apparatus control unit 301 drivingly controls the automatic original feeding apparatus 500 (see FIG. 1) in accordance with instructions from the image forming apparatus control unit 305. The image reader control unit 302 driving controls optical systems such as a light source, lenses, and image pickup device, and also transfers an analog RGB pixel signal output from the image pickup device to the image signal control unit 303.

The image signal control unit 303 converts the analog RGB pixel signal into a digital signal, then subjects it to various types of processing, converts the digital signal into a video signal, and outputs the video signal to the printer control unit 304. Processing by the image signal control unit 303 is controlled by the image forming apparatus control unit 305.

The operation unit 308 is comprised of a plurality of keys for setting various functions relating to image formation, a display for displaying information indicative of setting statuses, and so on. Key signals corresponding to respective key operations of the operation unit 308 are supplied to the image forming apparatus control unit 305 which acts as a calculation unit and an input unit. Based on signals from the image formation apparatus control unit 305, corresponding information is displayed on the display or the like of the operation unit 308. An operation screen 308*a* of the operation unit 308 acts as a receiving unit that receives type of a sheet input from the user. On the operation screen 308*a* as shown in FIG. 6B, the user selects a type of a sheet such as a thick sheet (second type) or a plain sheet (first type). Information on the selected type is stored in the RAM 307.

On the other hand, the sheet post-processing apparatus control unit 501, which is installed in the sheet post-processing apparatus 100, controls operation of the sheet post-processing apparatus 100 by carrying out data communications with the image formation apparatus control unit 305 via a communication IC (not shown). The sheet post-processing apparatus control unit 501 has a CPU 401, a ROM 402, and a RAM 403.

The CPU 401 controls various actuators and various sensors by executing control programs stored in the ROM 402. For example, the entrance sensor 101, a conveying motor 208 that drives the entrance roller pairs 102, 105, and 106, and so on are controlled by the sheet post-processing apparatus control unit 501.

A punch motor driver 279, a conveying motor driver 278, the first and second HP sensors 271 and 272, and the punch motor clock sensor 276 are connected to the sheet post-processing apparatus control unit 501. The punch motor driver 279 drives the punch motor 221. The conveying motor driver 278 drives the conveying motor 208. The RAM 403 temporarily holds control data and is used as a work area for computations associated with control.

A description will now be given of a punching operation according to the present embodiment.

Figure 7:
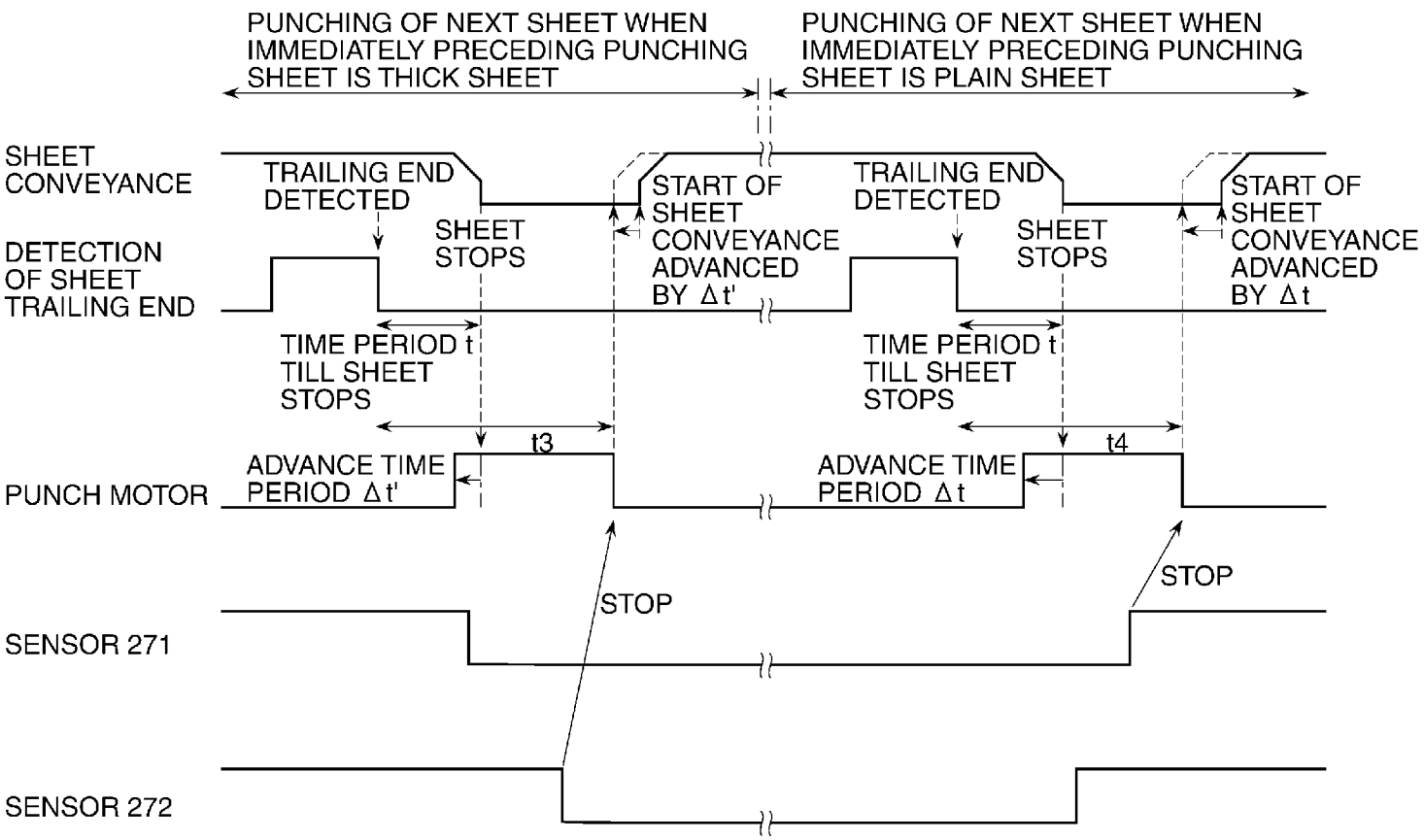
FIG. 7 is a timing chart showing changes in signals from units during punching.

FIG. 7 is a timing chart showing changes of signals from units during punching. The punching operation is controlled by the CPU 401.

In FIG. 7, cases where a sheet to be punched (hereafter also referred to as the immediately preceding punching sheet) immediately preceding a sheet to be punched this time is a thick sheet and a plain sheet are particularly taken up as examples. The first and second HP sensors 271 and 272 are HIGH when they are shielded from light and LOW when they are unshielded from light.

A sheet discharged from the image forming apparatus 300 is brought into the sheet post-processing apparatus 100, and the entrance sensor 101 of the sheet post-processing apparatus 100 changes from ON to OFF when a trailing end of the sheet is detected. First, assume that the slider 260 moves toward the front to perform punching. In a case where the immediately preceding punching sheet is a thick sheet, when a time period $(t-\Delta t')$ has elapsed since the trailing end of the sheet was detected, the punch motor 221 is started, causing the slider 260 to start moving.

Here, a time period $\underline{t}$ is a time period from when a trailing end of a sheet is detected to when conveyance of the sheet is stopped at a predetermined punching position. Advance time periods $\Delta t$ and $\Delta t'$ are required anticipated time periods from when the punch motor 221 is started to when punching by the punches 273 is actually started. The relationship between the time periods is as follows: $\Delta t>\Delta t'$, where the advance time period in a case where the immediately preceding punching sheet is a plain sheet is Δt, and the advance time period in a case where the immediately preceding punching sheet is a thick sheet is Δt'.

Because the punch motor 221 is started when the time period (t−Δt') has elapsed before lapse of the time period t, the timing with which the slider 260 starts moving so as to punch the sheet to be punched this time is advanced. As a result, the timing with which conveyance of the sheet to be punched this time stops and the actual start of punching by the punches 273 substantially coincide with each other.

Figure 9:
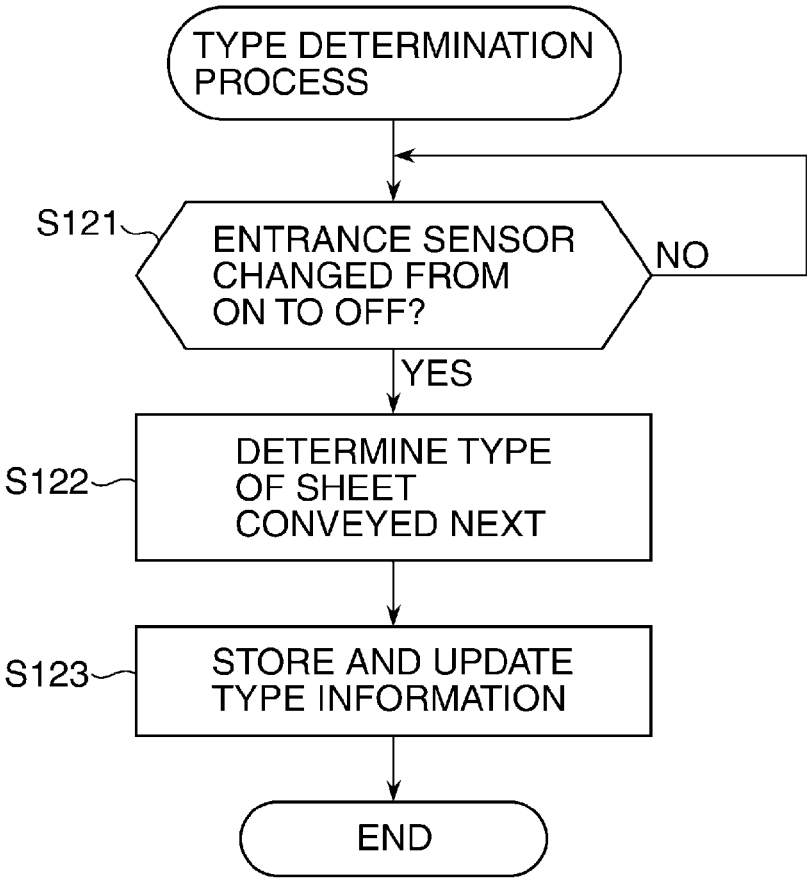
FIG. 9 is a flowchart showing a type determination process carried out in step S100 in FIG. 8.

The CPU 401 obtains information on a type of the sheet discharged from the image forming apparatus 300 using any of methods described hereafter and determines the type (see step S122 in FIG. 9). First, information input via the operation screen 308*a* by the user and stored in the RAM 307 is posted from the image forming apparatus control unit 305 to the sheet post-processing apparatus control unit 501 when the sheet is discharged from the image forming apparatus 300. The CPU 401 determines a type of the sheet using the posted information. Alternatively, the CPU 401 determines a type of the sheet using information on a displacement amount of the roller 102 detected by the laser displacement meter 850.

After the sheet is punched by the punches 273, the punch motor 221 stops when the slider 260 having shielded the second HP sensor 272 from light leaves the second HP sensor 272, and the second HP sensor 272 becomes unshielded from light.

The slider 260 then moves toward the rear to perform punching. In a case where the immediately preceding punching sheet is a plain sheet, when a time period (t−Δt) has elapsed since the trailing end of the sheet was detected by the entrance sensor 101, the punch motor 221 is started, causing the slider 260 to start moving.

Thus, because the punch motor 221 is started when, before the lapse of the time period t, the time period (t−Δt) has elapsed since the trailing end of the sheet was detected by the entrance sensor 101, the timing with which the slider 260 starts moving so as to perform punching on the sheet to be punched this time is advanced. Thus, the timing with which conveyance of the sheet to be punched this time stops and the actual start of punching substantially coincide with each other.

Then, when the first HP sensor 271 is brought into a state of being shielded from light by the slider 260 after the sheet is punched by the punches 273, the punch motor 221 stops.

Due to the above described process, as compared to a total punching time period t3 required in a case where the immediately preceding punching sheet is a thick sheet, only a punching time period t4 (<t3) is required in a case where the immediately preceding punching sheet is a plain sheet. Thus, when the immediately preceding punching sheet is a plain sheet, punching time can be shortened by a time period (t3−t4) as compared to the case of a thick sheet. As a result, as compared to a case where the timing with which the punch motor 221 is started is across the board the time at which the time period (t−Δt') has elapsed since a trailing end of a sheet was detected, processing time can be shortened to enhance productivity.

FIG. 7 illustrates the case where the slider 260 is at the initial position appearing in FIG. 3 at the start of punching, and the immediately preceding punching sheet is a thick sheet, and the case where the slider 260 is at the position appearing in FIG. 5, and the immediately preceding punching sheet is a plain sheet. The combination of the position of the slider 260 at the start of punching and the immediately preceding punching sheet may be the reverse of the example shown in FIG. 7. The operation in FIG. 7 will be described with reference to a flowchart of FIG. 8.

FIG. 8 is the flowchart of a punching process. This process is started by the CPU 401 of the sheet post-processing apparatus control unit 501 when the user issues an instruction to start a job such as copying.

First, in step S100, the CPU 401 carries out a type determination process in FIG. 9.

FIG. 9 is a flowchart showing a type determination process carried out in the step S100 in FIG. 8.

In step S121 in FIG. 9, the CPU 401 determines whether or not a trailing end of a sheet has been detected, that is, whether or not the entrance sensor 101 has changed from ON to OFF. When the entrance sensor 101 has changed from ON to OFF, the CPU 401 determines a type of a sheet to be conveyed next, that is, a type of a sheet to be punched this time in step S122 (a determination unit). This determination is made by, for example, referring to information input via the operation screen 308*a* and posted from the image forming control apparatus control unit 305 to the sheet post-processing apparatus control unit 501 as described earlier.

Then, in step S123, the CPU 401 stores the information on the determined type of the sheet in the RAM 403. Sheet type information is rewritten whenever a sheet is conveyed. Information on the type of the sheet to be punched this time is held at least until punching of a sheet subsequent to the sheet to be punched this time is completed. The information on the type held here is used in determining a type of the immediately preceding punching sheet in step S102 in FIG. 8. The information on the type of the sheet is held until power supply to the sheet post-processing apparatus 100 is turned on or off. After the process in the step S123, the present process is brought to an end, and the process proceeds to step S101 in FIG. 8.

In the step S101 in FIG. 8, the CPU 401 determines whether or not the sheet to be punched this time is the first sheet in the job. When the sheet to be punched this time is the first sheet in the job, the process proceeds to step S108, and on the other hand, when the sheet to be punched this time is the second sheet or any of the subsequent sheets in the job, the process proceeds to the step S102. In the step S102, based on the type information stored in the RAM 403, the CPU 401 determines whether or not the type of the immediately preceding punching sheet is a thick sheet. When, as a result of the determination, the type of the immediately preceding punching sheet is a thick sheet, the process proceeds to step S103, and on the other hand, when the type of the previous punched sheet is not a thick sheet, the process proceeds to the step S108.

In the step S103, the CPU 401 sets an advance time at Δt'. Then, in step S104, the CPU 401 determines whether or not the time period (t−Δt') has elapsed since the entrance sensor 101 changed to OFF. The CPU 401 waits for lapse of the time period (t−Δt'), and when the time period (t−Δt') has elapsed, the CPU 401 proceeds to step S105, in which it outputs a start signal to the punch motor driver 279 (FIG. 6A) so as to start the punch motor 221.

Then, in step S106, the CPU 401 determines whether or not the time period t has elapsed since the entrance sensor 101 changed to OFF. The CPU 401 waits for lapse of the time period t, and when the time period t has elapsed, the CPU 401 proceeds to step S107, in which it outputs a stop signal to the convening motor driver 278 (FIG. 6A) so as to stop sheet conveyance, and then proceeds to step S113.

In the step S113, the CPU 401 determines whether or not the output of one of the first and second HP sensors 271 and 272 which is located forward in a direction in which the slider 260 is moving this time has been inverted. For example, when the slider 260 is moving toward the front this time, it is determined whether or not the second HP sensor 272, which is located forward in the direction of movement of the slider 260, has changed from the light-shielded state to the light-unshielded state. Conversely, when the slider 260 is moving toward the rear this time, it is determined whether or not the first HP sensor 271, which is located forward in the direction of movement of the slider 260, has changed from the light-unshielded state to the light-shielded state.

The CPU 401 continues to make the determination until the output of an HP sensor located forward in the direction of movement of the slider 260 is inverted, and when the output is inverted, the CPU 401 proceeds to step S114, in which it outputs a stop signal to the punch motor driver 279 so as to stop the punch motor 221. The CPU 401 then proceeds to step S115, in which it outputs a start signal to the conveying motor driver 278 so as to resume sheet conveyance.

Then, in step S116, the CPU 401 determines whether or not the job has been completed. When the job has not been completed, the process returns to the step S100, and on the other hand, when the job has been completed, the process proceeds to step S118. In the step S118, the CPU 401 starts the punch motor 221 to initialize the slider 260, that is, moves the slider 260 back to the initial position (FIG. 3A). The present process is then brought to an end.

When, in the step S102, the type of the immediately preceding sheet is not a thick sheet, the CPU 401 sets the advance time period at Δt. Then, in step S109, the CPU 401 determines whether or not the time period (t−Δt) has elapsed since the entrance sensor 101 changed to OFF. The CPU 401 waits for lapse of the time period (t−Δt), and when the time period (t−Δt) has elapsed, the CPU 401 proceeds to step S110, in which it outputs a start signal to the punch motor driver 279 so as to start the punch motor 221.

Then, in step S111, the CPU 401 determines whether or not the time period t has elapsed since the entrance sensor 101 changed to OFF. The CPU 401 waits for lapse of the time period t, and when the time period t has elapsed, the CPU 401 proceeds to step S112, in which it outputs a stop signal to the convening motor driver 278 so as to stop sheet conveyance, and then proceeds to step S117.

In the step S117, the CPU 401 determines whether or not the output of one of the first and second HP sensors 271 and 272 which is located forward in a direction in which the slider 260 is moving this time has been inverted. The CPU 401 continues to make the determination until the output of an HP sensor located forward in the direction of movement of the slider 260 is inverted, and when the output is inverted, the CPU 401 proceeds to the step S114. Processes in the step S114 and the subsequent steps are carried out in the same way as described above.

A description will now be given of a method to generate type information by detecting a type of a sheet in the sheet post-processing apparatus 100 in a case where the user has not selected a type of a sheet via the operation unit 308.

Figures 10A, 10B:
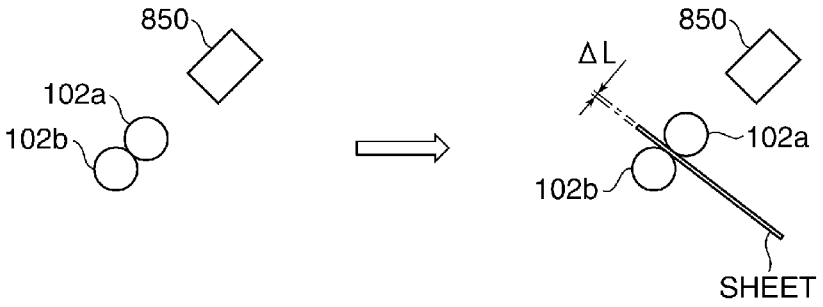
FIG. 10A is a schematic view showing how a laser displacement meter detects a type of a sheet.
FIG. 10B is a conceptual diagram showing a type table.

FIG. 10A is a schematic view showing how the laser displacement meter 850 (FIG. 6A) detects a type of a sheet. FIG. 10B is a conceptual diagram showing a type table for sheets.

The type table appearing in FIG. 10B, which holds information on the correspondence relationship between sheet thickness and sheet type, is stored in advance in the ROM 402 of the sheet post-processing apparatus control unit 501.

When a sheet discharged from the image forming apparatus 300 is brought into the sheet post-processing apparatus 100 to reach the entrance roller pair 102*a* and 102*b*, the roller 102*a* is separated from the roller 102*b* by an amount ΔL due to the thickness of the sheet. The laser displacement meter 850 measures this separating distance to determine the thickness of the sheet.

Based on the thickness of the sheet determined according to a measurement result by the laser displacement meter 850, the CPU 401 refers to the type table appearing in FIG. 10B and determines the corresponding type of the sheet. For example, when the determined thickness of the sheet is 0.093 mm, the type of the sheet is an A sheet.

In the present embodiment, two types of punching are used according to whether a type of a sheet is a thick sheet or a plain sheet, and the CPU 401 determines that a sheet type with a thickness not less than a predetermined value is a thick sheet (second type), and a thickness less than the predetermined value is a type other than a thick sheet (first type).

According to the process in FIG. 8, the advance time period (Δt, Δt') for advancing the start of a punching process is set according to a type of the immediately preceding punching sheet. As a result, when the type of the immediately preceding punching sheet is a type other than a thick sheet, the timing with which the slider 260 starts moving so as to punch a sheet to be punched this time is earlier compared to the case where the immediately preceding punching sheet is a thick sheet. Thus, the timing with which each punching process is started can be appropriately set without the need to set a uniform advance time period Δt' which is set in the case where the immediately preceding punching sheet is a thick sheet, and this leads to an improvement in productivity while maintaining high quality of deliverables.

Therefore, according to the present embodiment, time wasted until actual start of punching can be shortened to improve productivity.

It should be noted that although in the present embodiment, the first and second types of a sheet are distinguished by the thickness of the sheet, the present invention is not limited to this. Examples of factors that cause a difference in a load on a motor when punching is carried out includes a basis weight, a sheet quality (surface property), and so on other than a thickness of a sheet, and also includes a combination of the basis weight and the sheet quality. According to these types of a sheet, the timing with which the slider 260 starts moving should be set. It should be noted that information on the basis weight and the sheet quality is set by an operator through the operation unit 308 in advance and stored in the RAM 307.

It should be noted that information on a type of the immediately preceding punching sheet should be obtained at least before the start of processing on a sheet to be punched this time. Thus, a type of the immediately preceding punching sheet should not always be detected before the immediately preceding punching sheet, but may be detected and information thereon may be stored during or after punching.

It should be noted that mechanisms for causing the punches 273 to reciprocate using the reciprocating slider 260 may be cam mechanisms other than the cam grooves 275 or mechanisms other than cam mechanisms.

In the second embodiment of the present invention, irrespective of a sheet type, the position at which the slider 260 stops is corrected for so that the slider 260 can start moving at the same position when it moves back and when it moves forth. Thus, arrangements relating to determination of a sheet type such as the laser displacement meter 850 and receipt of a type on the operation screen 308*a* are not essential. A description will be given of the present embodiment using FIG. 7 and FIG. 12 in place of FIG. 11 and FIGS. 8 and 9, respectively, showing the first embodiment. Other arrangements are the same as those of the first embodiment.

Figure 11:
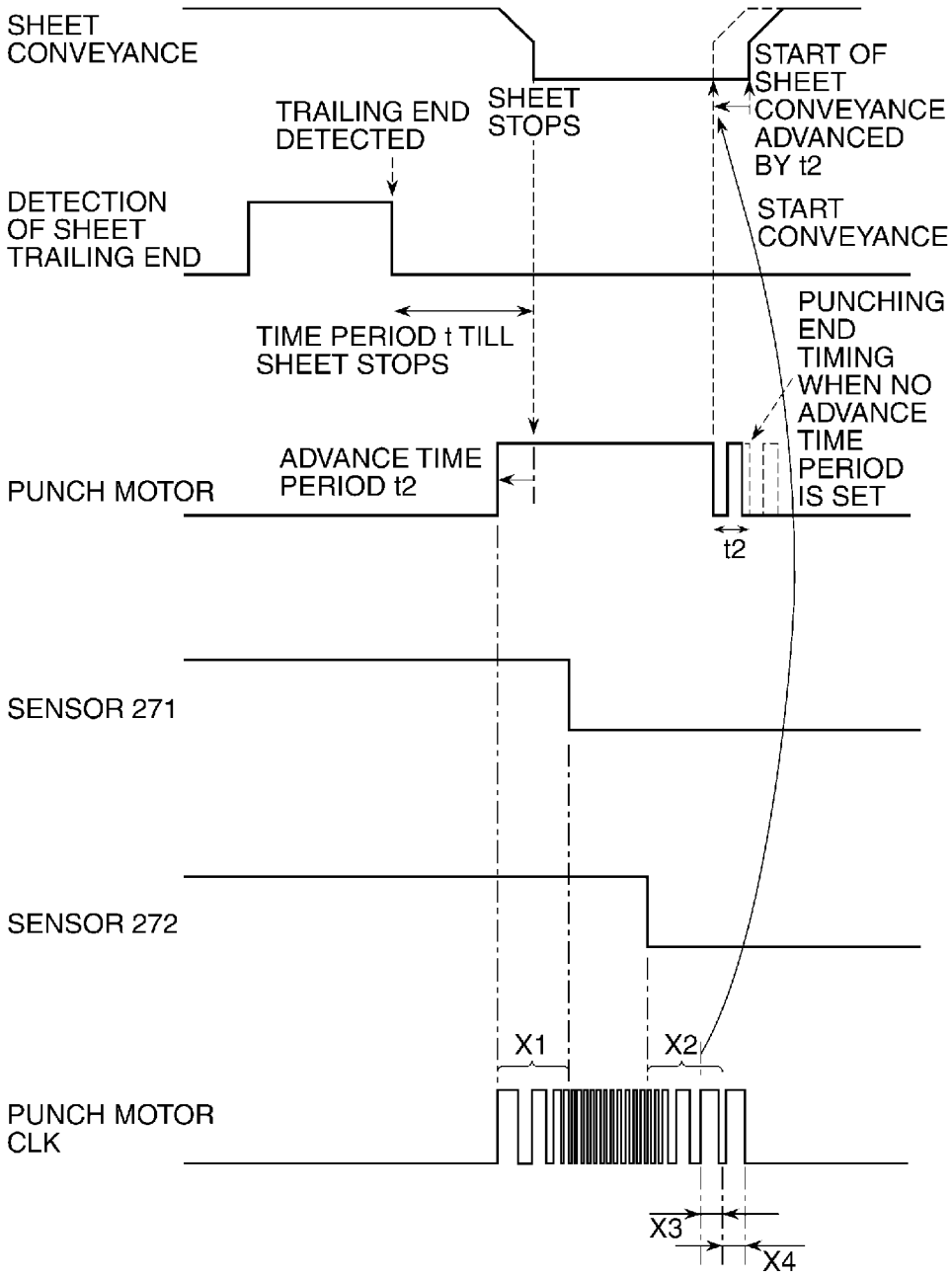
FIG. 11 is a timing chart showing changes of signals from units during punching according to a second embodiment of the present invention.
Figure 12:
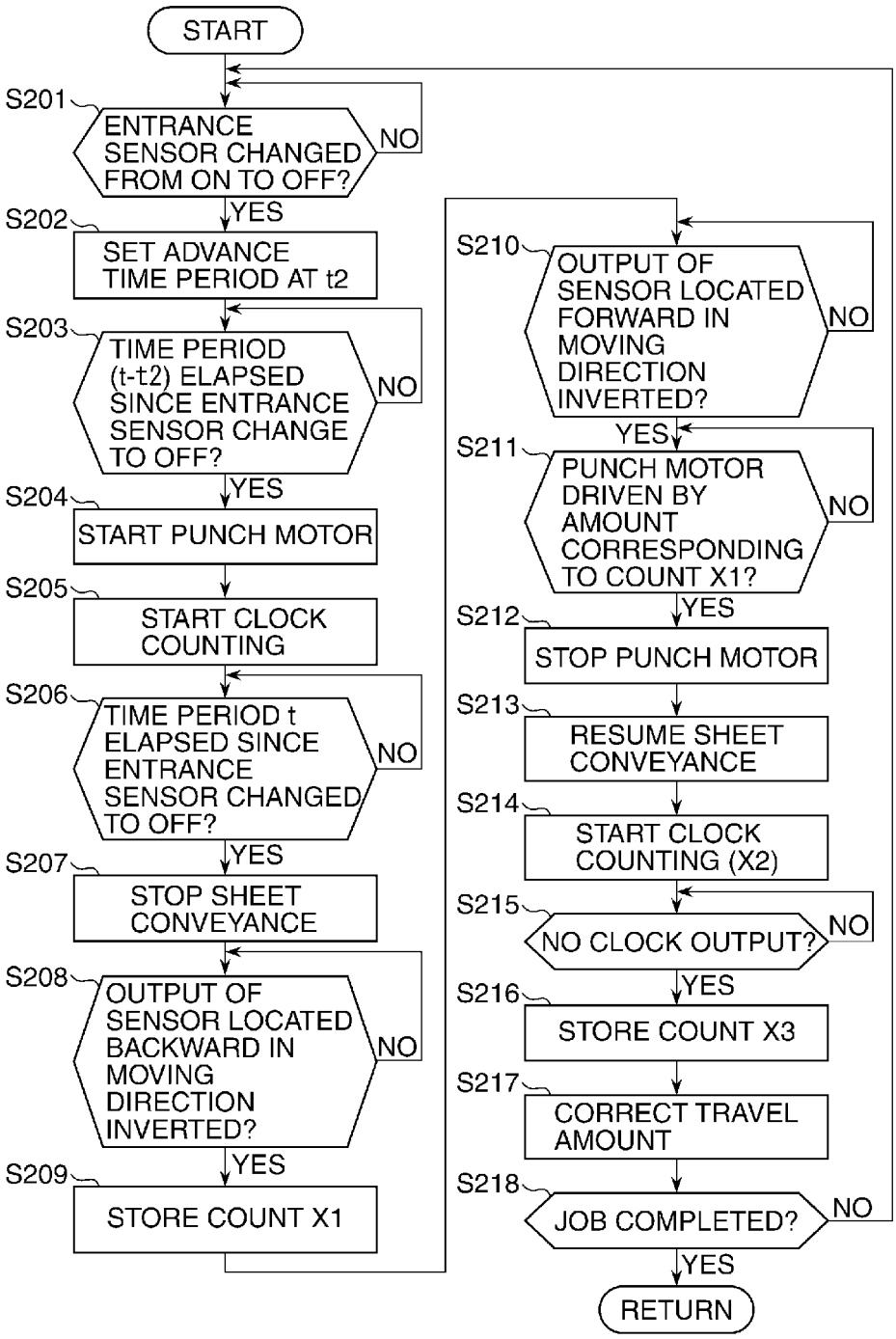
FIG. 12 is a flowchart of a punching process.

FIG. 11 is a timing chart showing changes of signals from units when punching is started in a case where the slider 260 stands still at the initial position appearing in FIG. 3A. FIG. 12 is a flowchart of a punching process.

In the following description of the present embodiment, as a matter of convenience, movement of the slider 260 moving toward the front is referred to as forward movement (corresponding to transition from a state shown in FIG. 3A to a state shown in FIG. 5A), and the reversal of this movement is referred to as backward movement. FIG. 11 shows forward movement.

In the present embodiment, control is provided such that a movement starting position of the slider 260 in forward movement and a movement starting position of the slider 260 in backward movement can be at the same distance from the intermediate position P0 (see FIG. 3). Thus, control is provided such that the distance between the movement starting position of the slider 260 in forward movement and the position at which the first HP sensor 271 is located (the first position) is the same as the distance between the movement starting position of the slider 260 in backward movement and the position at which the second HP sensor 272 is located (the second position).

The punch motor clock sensor 276 acts as a measurement unit that measures the travel distance of the slider 260. The CPU 401 controls the punch motor 221 based on results of detection by the first and second HP sensors 271 and 272 at the end position 260*a* which is a specific part and a result of measurement by the punch motor clock sensor 276.

Referring to FIG. 11, a sheet discharged from the image forming apparatus 300 is brought into the sheet post-processing apparatus 100, and the entrance sensor 101 of the sheet post-processing apparatus 101 changes from ON to OFF when a trailing end of the sheet is detected. When a time period (t−t2) has elapsed since the trailing end of the sheet was detected, the punch motor 221 is started, causing the slider 260 to start moving. Here, the advance time period t2 is a required anticipated time period from starting of the punch motor 221 to actual start of punching by the punches 273, and is fixed at a predetermined value by setting the moving start position.

After the punch motor 221 is started, clocks output from the punch motor clock sensor 276 until the first HP sensor 271 that has been shielded from light by the slider 260 is brought into the light unshielded state are counted (the count X1). The punches 273 punch the sheet, and when the slider 260 having shielded the second HP sensor 272 from light leaves the second HP sensor 272 to bring the second HP sensor 272 into the light-unshielded state, the punch motor 221 is continuously driven by an amount corresponding to the travel amount corresponding to the count X1. Thereafter, the punch motor 221 stops, and conveyance of the sheet is started. Because the advance time period t2 is set, end of punching and conveyance of the sheet are advanced by t2 as compared to a case where the advance time period t2 is not set.

Here, even when an attempt to stop the punch motor 221 is made, the punch motor 221 cannot immediately stop, causing the slider 260 to overrun. Therefore, in order to correct for an excess travel amount (X3) by which the slider 260 has overrun, the punch motor 221 is re-driven by the same amount (X4=X3) so that the slider 260 is moved back in an opposite direction. As a result, the slider 260 is positioned at the movement starting position for backward movement.

Namely, first, outputs from the punch motor clock sensor 276 are counted from the time at which the second HP sensor 272 becomes unshielded from light. Thereafter, the count X2 is counted until the slider 260 actually stops (there is no output from the punch motor clock sensor 276). The punch motor 221 moves in an opposite direction by an amount corresponding to the count X4 equal to the count X3 (=X2−X1), which is the excess travel amount, to move the slider 260 back. It should be noted that at the time of correcting for the position of the slider 260, no punches 273 lie on the sheet conveying path, and hence at this point, no problem will arise if an already punched sheet is conveyed.

It should be noted that although forward movement is illustrated in FIG. 11, the order and direction in which the output of the HP sensors 271 and 272 is inverted are merely reversed in backward movement as described with reference to FIG. 7. For example, the time at which counting of the count X1 ends is the time at which the second HP sensor 272 having been unshielded from light becomes unshielded from light. The time at which counting of the count X2 starts is the time at which the first HP sensor 271 having been unshielded from light becomes shielded from light.

Because the position at which the slider 260 stops is thus corrected for, the movement starting positions for forward movement and backward movement are symmetric with respect to the intermediate position P0 in the moving directions of the slider 260. For this reason, the timing with which the slider 260 starts moving is common to forward movement and backward movement, and in either of forward movement and backward movement, the above timing corresponds to a time point before conveyance of a sheet to be punched is stopped, and the time period (t1−t2) has elapsed since a trailing end of a sheet was detected. The operation in FIG. 11 will be described with reference to a flowchart of FIG. 12.

First, in step S201 in FIG. 12, the CPU 401 determines whether or not a trailing end of a sheet has been detected, that is, the entrance sensor 101 has changed from ON to OFF. When the entrance sensor 101 has changed from ON to OFF, the CPU 401 proceeds to step S202, in which it sets the advance time period at t2.

Then, in step S203 in FIG. 12, the CPU 401 determines whether or not the time period (t−t2) has elapsed since the entrance sensor 101 has changed from ON to OFF. The CPU 401 waits for lapse of the time period (t−t2), and when the time period (t−t2) has elapsed, the CPU 401 proceeds to step S204, in which it outputs a start signal to the punch motor driver 279 (FIG. 6A) so as to start the punch motor 221.

Next, in step S205, the CPU 401 starts counting clocks output from the punch motor clock sensor 276 (counting of the count X1 is started). Then, in step S206, the CPU 401 determines whether or not the time period t has elapsed since the entrance sensor 101 has changed to OFF. The CPU 401 waits for lapse of the time period t, and when the time period t has elapsed, the CPU 401 proceeds to step S207, in which it outputs a stop signal to the conveying motor driver 278 (FIG. 6A) so as to stop sheet conveyance and proceeds to step S208.

In the step S208, the CPU 401 determines whether or not the output of one of the first and second HP sensors 271 and 272 which is located rearward in a direction in which the slider 260 is moving this time has been inverted. The CPU 401 continues to make the determination until the output of an HP sensor located rearward in the direction of movement of the slider 260, and when the output is inverted, the CPU 401 proceeds to step S209, in which it stores the count X1 counted until then in the RAM 403.

Then, in step S210, the CPU 401 determines whether or not the output of one of the first and second HP sensors 271 and 272 which is located forward in the direction in which the slider 260 is moving this time has been inverted. The CPU 401 continues to make the determination until the output of an HP sensor located forward in the direction of movement of the slider 260, and when the output is inverted, the CPU 401 proceeds to step S211, in which it determines whether or not the punch motor 221 has been driven to such an extent as to move the slider 260 by an amount corresponding to the count X1.

The CPU 401 continues to drive the punch motor 221 until the slider 260 has moved by the amount corresponding to the count X1. When the slider 260 has moved by the amount corresponding to the count X1, the CPU 401 proceeds to step S212, in which it outputs a stop signal to the conveying motor driver 278 to stop sheet conveyance. Then, the CPU 401 proceeds to step S213, in which it outputs a start signal to the conveying motor driver 278 so as to resume sheet conveyance.

Then, in step S214, the CPU 401 starts counting outputs from the punch motor clock sensor 276 (counting of the count X2 is started). Next, in step S215, the CPU 401 determines whether or not there is no clock output from the punch motor clock sensor 276. The CPU 401 continues to make the determination until there is no clock output. Here, the case where there is no clock output corresponds to a case where the slider 260 has stopped overrunning. Accordingly, the CPU 401 stores the count X3, which is obtained by subtracting the count X1 from the count X2 counted till the time at which there is no clock output, in the RAM 403. The count X3 corresponds to an excess travel amount of the slider 260 from a target position at which it is stopped.

Then, in step S217, the CPU 401 corrects for the travel amount of the slider 260. Namely, the CPU 401 causes the slider 260 to move in an opposite direction by driving the punch motor 221 in an opposite direction by an amount corresponding to the count X4 equal to the count X3. As a result, the slider 260 stops at a movement starting position for punching the next sheet which is a target position.

Then, in step S218, the CPU 401 determines whether or not the job has been completed. When the job has not been completed, the process returns to the step S201, and when the job has been completed, the process in FIG. 12 is brought to an end.

According to the present embodiment, irrespective of a type of the immediately preceding punching sheet such as a thickness (punching load), the position at which the slider 260 starts moving based on the intermediate position P0 is uniform at the start of punching this time. Thus, movement of the slider 260 can be started with the same timing (t–t2) when it moves back and when it moves forth irrespective of a sheet type, the time period from when a trailing end of a sheet is detected to when the punch motor 221 is started (t–t2) can be set at the smallest value possible. As a result, the same effects as in the first embodiment can be obtained insofar as reduction in time wasted until actual start of punching can be shortened to enhance productivity is concerned.

Other Embodiments

Aspects of the present invention can also be realized by a computer of a system or apparatus (or devices such as a CPU or MPU) that reads out and executes a program recorded on a memory device to perform the functions of the above-described embodiment(s), and by a method, the steps of which are performed by a computer of a system or apparatus by, for example, reading out and executing a program recorded on a memory device to perform the functions of the above-described embodiment(s). For this purpose, the program is provided to the computer for example via a network or from a recording medium of various types serving as the memory device (e.g., computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-185377 filed Aug. 24, 2012, which is hereby incorporated by reference herein in its entirety.

What is claimed is:

1. A sheet post-processing apparatus comprising:

a moving member configured to have a cam and reciprocate;

a drive unit configured to cause said moving member to reciprocate;

a punching member configured to be driven by a movement of the cam of said moving member and punch a sheet when said moving member moves forth and moves back;

a determination unit configured to determine a type of the sheet; and a control unit configured to, when a sheet to be punched is to be subjected to a punching process, control said drive unit such that said moving member starts moving before conveyance of the sheet to be punched stops, and when the sheet to be punched is to be subjected to the punching process, control said drive unit such that timing with which said moving member starts moving is changed based on the determination by said determination unit, wherein a type of an immediately preceding sheet punched prior to the sheet to be punched is a first type, said control unit controls said drive unit such that said moving member starts moving with earlier timing compared to a case where the type of the immediately preceding sheet is a second type that puts a heavier load on said drive unit than the first type.

2. A sheet post-processing apparatus comprising:

a moving member configured to have a cam and reciprocate;

a drive unit configured to cause said moving member to reciprocate;

a punching member configured to be driven by a movement of the cam of said moving member and punch a sheet when said moving member moves forth and moves back;

a determination unit configured to determine a type of the sheet; and a control unit configured to, when a sheet to be punched is to be subjected to a punching process, control said drive unit such that said moving member starts moving before conveyance of the sheet to be punched stops, and when the sheet to be punched is to be subjected to the punching process, control said drive unit such that timing with which said moving member starts moving is changed based on the determination by said determination unit, wherein the type of the sheet is determined based on at least one of a thickness of the sheet, a basis weight of the sheet and a surface property of the sheet.

3. The sheet post-processing apparatus according to claim 1, wherein timing with which said moving member starts moving is set such that timing with which conveyance of the sheet to be punched stops coincide with actual start of punching by said punching member.

4. The sheet post-processing apparatus according to claim 1, further comprising a receiving unit configured to receive input of information on the type of the sheet, wherein said determination unit determines the type of the conveyed sheet based on the information received by said receiving unit.

5. The sheet post-processing apparatus according to claim 1, further comprising a sensor configured to detect a thickness of the conveyed sheet, wherein said determination unit determines the type of the conveyed sheet based on the thickness of the sheet.

6. The sheet post-processing apparatus according to claim 1, further comprising:

an input unit for inputting information on each of the basis weight of the sheet and the surface property of the sheet; and a storage unit configured to store the input information, wherein said determination unit determines a type of the sheet based on the information stored in said storage unit.

7. A sheet post-processing apparatus comprising:

a moving member configured to have a cam and reciprocate;

a drive unit configured to cause said moving member to reciprocate;

a punching member configured to be reciprocated, when said moving member moves forth and moves back, by a movement of the cam of said moving member, and punch a sheet;

a measurement unit configured to measure a travel amount of said moving member;

a detection unit configured to detect, with respect to a position of said moving member at timing with which said punching member changes a direction of movement in reciprocating movement, a first state in which said moving member is distant by a predetermined distance in a first direction between the directions of movement of said moving member and a second state in which said moving member is distant by the predetermined distance in a second direction opposite to the first direction; and a control unit configured to, in a case where a sheet to be punched is subjected to a punching process, (i) control said drive unit such that said moving member starts moving before conveyance of the sheet to be punched is stopped, (ii) control said drive unit such that said drive unit stops driving when a first travel amount of said moving unit measured by said measurement unit from when said drive unit starts driving until said detection unit detects the first state and a second travel amount of said moving unit measured by said measurement unit after said detection unit detected the second state become equal, and (iii) control said drive unit so as to cause said moving member to move to a predetermined position by a third travel amount of said moving member, which is measured by said measurement unit from when said drive unit stops driving until said moving member stops, by changing the direction of movement of said moving member.

8. The sheet post-processing apparatus according to claim 7, wherein said control unit set the predetermined position as a movement starting position of said moving member in a case where the punching process is subjected to a next sheet to be subjected.

* * * * *